US007278228B2

(12) United States Patent
Arzberger et al.

(10) Patent No.: US 7,278,228 B2
(45) Date of Patent: Oct. 9, 2007

(54) HINGED TOOTH

(75) Inventors: Maximilian Michael Arzberger, Hollenbach (DE); Ignaz Anton Seitle, Karlshuld (DE); Ludwig Andreas Huber, Thalhausen (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 324 days.

(21) Appl. No.: 11/006,705

(22) Filed: Dec. 8, 2004

(65) Prior Publication Data

US 2005/0132620 A1 Jun. 23, 2005

(30) Foreign Application Priority Data

Dec. 23, 2003 (DE) ..... 103 60 910

(51) Int. Cl.
*E02F 9/28* (2006.01)

(52) U.S. Cl. ..... 37/455; 37/447; 37/450; 299/85.2; 299/108

(58) Field of Classification Search ..... 37/446–460; 299/85.1, 80.1, 85.2, 108, 112
See application file for complete search history.

(56) References Cited

U.S. PATENT DOCUMENTS 3,279,856 A * 10/1966 Silks ..... 299/85.1
3,290,099 A * 12/1966 Lundquist ..... 299/85.1
4,391,472 A * 7/1983 Krekeler ..... 299/85.1
4,718,731 A * 1/1988 Bauer et al. ..... 299/85.2
4,834,197 A * 5/1989 Bauer et al. ..... 175/91
5,212,895 A * 5/1993 Camilleri ..... 37/364

FOREIGN PATENT DOCUMENTS

| | | |
|---|---|---|
| DE | 39 26 9786 | 2/1991 |
| EP | 0 291 027 | 11/1988 |
| EP | 1 350 893 | 10/2003 |
| FR | 2295179 A1 | 7/1976 |
| FR | 2 805 552 | 8/2001 |
| SU | 1 010 217 | 4/1983 |
| SU | 1 086 152 | 4/1984 |
| WO | WO89/00631 | 1/1989 |

* cited by examiner

*Primary Examiner*—Thomas A Beach
(74) *Attorney, Agent, or Firm*—Jacobson Holman PLLC

(57) ABSTRACT

The invention relates to a hinged tooth for a cutting wheel comprising a pivot bearing for pivotally supporting on a pivot pin located on a cutting wheel hub, a cutting tooth support extending from the pivot bearing and a steering arm extending from the pivot bearing substantially in a direction opposite to that of the cutting tooth support. A simple and at the same time stable arrangement is achieved in that the pivot bearing, the cutting tooth support and the steering arm are designed as a one-piece support.

10 Claims, 3 Drawing Sheets

HINGED TOOTH

BACKGROUND OF THE INVENTION

1. Field of the Invention

The invention relates to a hinged tooth for a cutting wheel comprising a pivot bearing for pivotally supporting on a pivot pin located on a cutting wheel hub, a cutting tooth support extending from the pivot bearing and a steering arm extending from the pivot bearing substantially in a direction opposite to that of the cutting tooth support.

2. Related Art

Hinged teeth of such kind are known from EP 0 291 027 B1 which also originates from the applicant. In trench cutters having cutting wheels arranged laterally on a bearing shield there exists the problem that the soil located immediately below the bearing shield cannot be worked off directly by the cutting wheels. It is therefore suggested in EP 0 291 027 B1 that the cutting teeth adjoining the bearing shield are hinged on the cutting wheels. Through a kind of cam steering the hinged teeth can be swung out in an area below the cutting shield in order to work off the soil lying underneath, while a further turning of the cutting wheel causes the hinged teeth to be swung in again so that the bearing shield is not damaged by the cutting teeth.

For functional reasons and on account of their required inclination the hinged teeth are exposed to considerable forces and stress, in particular if a more compact soil or a rocky underground needs to be worked upon. Hence, the known hinged teeth are exposed to excessive wear and can also suffer from premature damage for which reason an early exchange is required. However, not only does an exchange of the hinged teeth lead to relatively long and therefore costly downtimes of the high-investment trench cutter but in addition the hinged teeth are relatively expensive on account of the pivot support required for them and the demanded wear resistance.

SUMMARY OF THE INVENTION

The invention is based on the object to provide a hinged tooth which has an improved stability whilst being easy to manufacture.

The object is solved in accordance with the invention by a hinged tooth for a cutting wheel comprising a pivot bearing for pivotally supporting on a pivot pin located on a cutting wheel hub, a cutting tooth support extending from the pivot bearing, and a steering arm extending from the pivot bearing substantially in a direction opposite to that of the cutting tooth support.

A hinged tooth in accordance with the invention is characterized in that the pivot bearing, the cutting tooth support and the steering arm are designed as a one-piece support. The hinged tooth can be manufactured by means of casting or forging, although a preferred manufacturing method is constituted by gas cutting of sheet metal. Compared to the embodiment as a welding construction the one-piece embodiment of the pivot bearing and of the single arms of the hinged tooth leads to an improved stability whilst reducing the manufacturing costs at the same time.

A preferred embodiment of the invention resides in the fact that a receiving portion is designed on the cutting tooth support, in which hardened cutting teeth are detachably mounted. The soil-breaking cutting teeth that are produced of a specifically hardened material can be inserted into the one-piece support. For the connection with the support conventional form or force-locking connecting means and joining methods can be employed.

According to the invention it is furthermore advantageous that a tapering is designed on the cutting tooth support between the pivot bearing and the receiving portion for the cutting teeth. Such a tapering results in an improved elasticity of the projecting cutting tooth support so that bending loads can be absorbed in the tapered part and the pivot bearing is relieved thereby. Moreover, this tapering also permits an improved pivoting of the hinged tooth towards the cutting shield.

In principle, the pivot bearing can be designed as a single bearing eye that is inserted into the support by means of gas cutting or drilling. However, in order to achieve an improved elasticity of the pivot bearing it is intended according to the invention that the pivot bearing has at least two mutually spaced bearing walls, which are each provided with a bearing eye arranged coaxially to each other. The bearing walls can be produced by applying a groove to the one-piece support. The bearing eyes can likewise be manufactured by means of gas cutting or drilling.

Another preferred embodiment of the invention resides in the fact that a stop member is arranged in the portion of the steering arm. This stop member serves for the contacting of the steering arm with the cutting wheel hub on which the hinged tooth is supported. Through this stop the maximum swing-out angle is limited with respect to the bearing shield. The stop member can be made of a highly wear-resistant material because during operation the hinged teeth exert a considerable pressure on the stop member on account of the outcropping soil.

According to the invention a further solution of the object stated above resides in the fact that a wearing plate is detachably and exchangeably supported on the steering arm. The wearing plate serves as a cam follower in order to establish a contact of the hinged tooth with the steering ridge located on the cutting shield, through which the moment and the extent of deflection of the hinged tooth are predetermined as a function of the rotational position of the cutting wheel. Unlike the stop member mentioned before, this wearing plate is exposed to a considerable degree of sliding friction for functional reasons. Therefore the wearing plate preferably includes lubricating alloys that may contain e.g. bronze or brass. The wearing plate can be manufactured separately so that the manufacturing costs of the hinged tooth are reduced altogether. In the case of a certain degree of wear the wearing plate can be exchanged quickly and at low cost while the support of the hinged tooth remains fixed to the cutting wheel.

However, according to the invention it is particularly preferred that the wearing plate is screwed to the steering arm. A screw connection can be manufactured in a particularly cost-effective way and can be unscrewed and tightened again easily.

In another embodiment of the invention it is advantageous that a guide groove is provided between the steering arm and the wearing plate. Such a guide, e.g. a dovetail guide, permits a quick and precise arrangement of the wearing plate on the hinged tooth. As a result, maintenance times and costs can be reduced further. A reducing of material concerning the wearing plate is achieved in accordance with the invention in that the wearing plate is designed in a kidney-shaped manner.

In this connection it is intended according to the invention that the wearing plate is designed in a bevelled manner at its lateral portions. This bevelling, which may be straight or arcuate, permits a smooth interaction with the steering ridge so that the hinged tooth can be swung in and out whilst largely avoiding any jolts. This also has a positive effect on the working life of the hinged tooth.

Basically the hinged tooth according to the invention can be used in various kinds of cutting wheels. However, a preferred application is the use in a trench cutter such as the one used in specialist foundation engineering to produce retaining or cut-off walls.

BRIEF DESCRIPTION OF THE DRAWINGS

In the following the invention will be described by way of a preferred embodiment that is schematically shown in the accompanying drawings wherein.

DETAILED DESCRIPTION OF THE PREFERRED EMBODIMENTS

Figure 1:
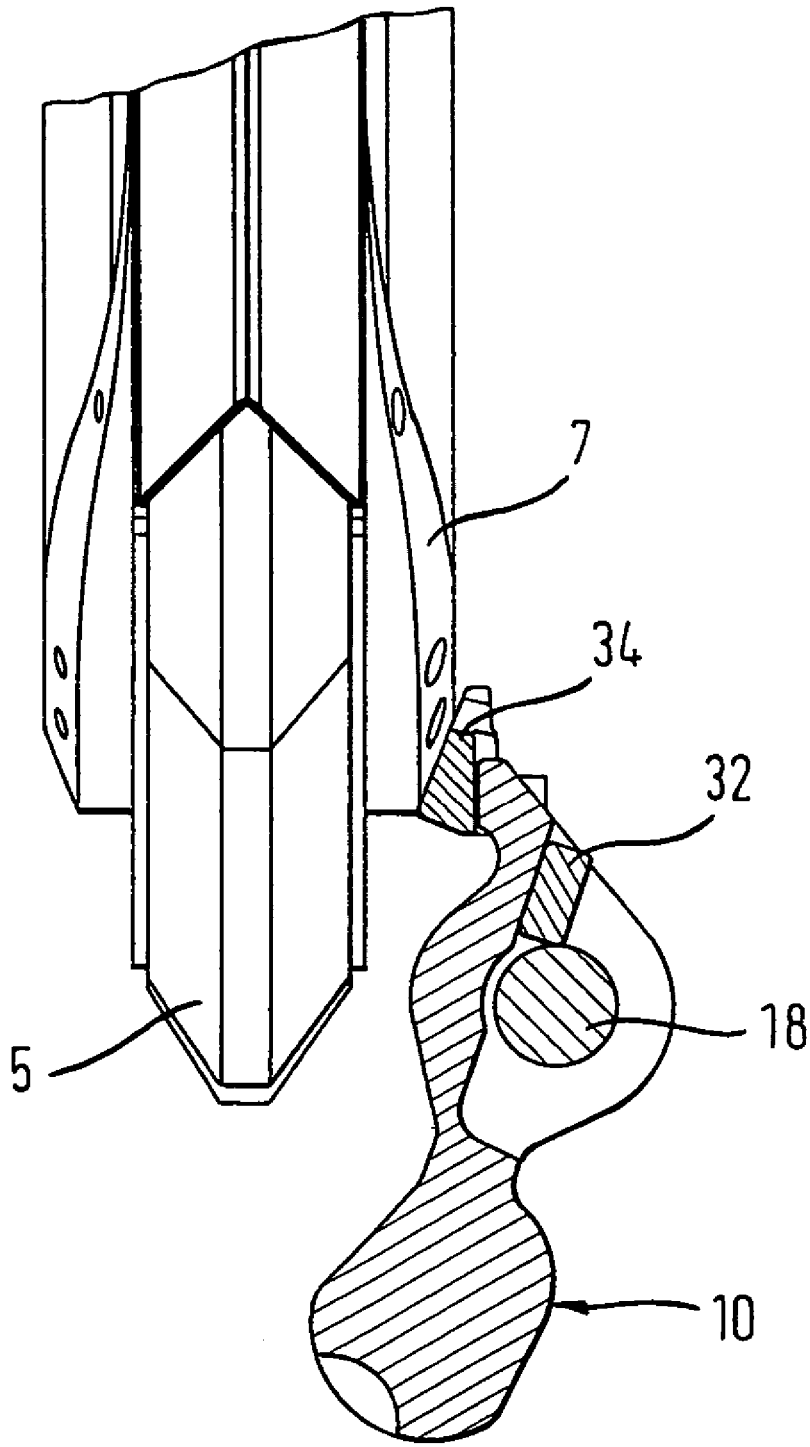
FIG. 1 shows a schematic, partially sectional view of a hinged tooth according to the invention on a bearing shield.
Figure 3:
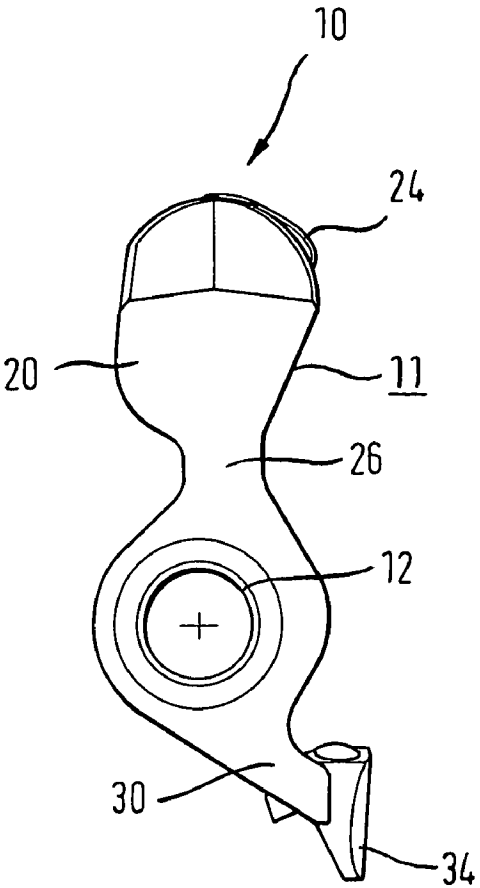
FIG. 3 shows a lateral view of the hinged tooth of FIG. 2.
Figure 2:
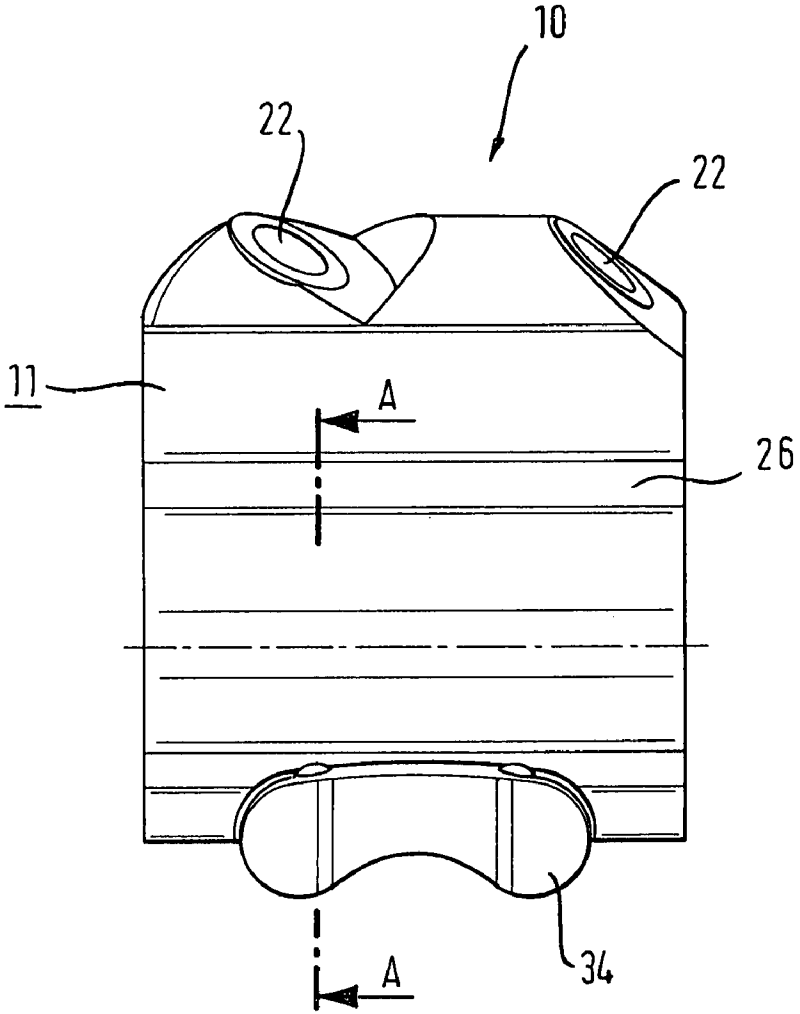
FIG. 2 shows a plan view of a hinged tooth according to the invention.
Figure 4:
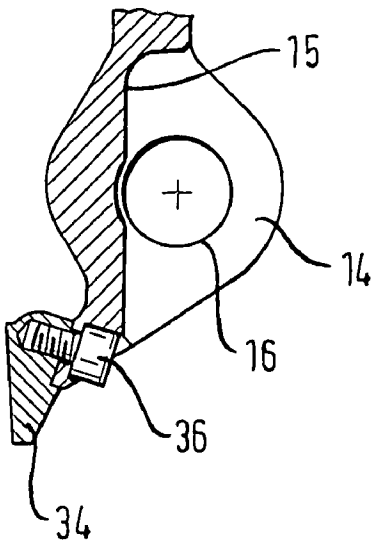
FIG. 4 shows a partially cross-sectional view of the hinged tooth according to section A-A of FIG. 2.

According to FIG. 1 the arrangement and function of a hinged tooth 10 according to the invention that is located on a bearing shield 5 of a trench cutter is illustrated. On either side of the bearing shield 5 two cutting wheels are each rotatably supported that are not depicted here for reasons of greater clarity. On the side of the cutting wheels facing towards the bearing shield 5 pivot pins 18 are arranged, on which a hinged tooth 10 is pivotally supported in known manner. The pivoting motion of the hinged tooth 10 is predetermined by a steering ridge 7 fixed to the bearing shield 5, along which the hinged tooth 10 slides. In FIG. 1 the operating position is shown in which the hinged tooth is swung out so that soil material below the bearing shield 5 can be stripped. The construction and function of the hinged tooth 10 will be explained in greater detail in conjunction with FIGS. 2 to 4.

The hinged tooth 10 has a one-piece body 11 in which a pivot bearing 12 is provided for accommodating the pivot pin mounted on the cutting wheel hub. As can be gathered from FIG. 4, there are two bearing walls 14 designed to form the pivot bearing 12 which are separated by a groove 15 and into each of which a bearing eye 16 is drilled. Both bearing eyes 16 are aligned coaxially to each other so that, if required, the pivot pin 18 can be inserted with a sliding sleeve whereby the hinged tooth 10 can be pivotally supported. To accommodate cutting teeth 24 that are only depicted schematically a so-called cutting tooth support 20 is designed on the body 11, into which two receiving portions 22 for the cutting teeth are inserted. In order to improve elasticity and for a better pivoting of the hinged tooth 10 a tapering 26 is designed on the body 11 between the pivot bearing 12 and the cutting tooth support 20 so that the body 11 is of an altogether hourglass-like shape.

A so-called steering arm 30 extends from the bearing portion 12 in a direction approximately opposite to the cutting tooth support 20, which is also formed as one piece on the body 11. At the free end of the steering arm 30 an approximately kidney-shaped wearing plate 34 is detachably and exchangeably mounted by means of a screw connection 36. In the following the wearing plate 34 will be described in more detail in conjunction with FIG. 5.

Figure 5:
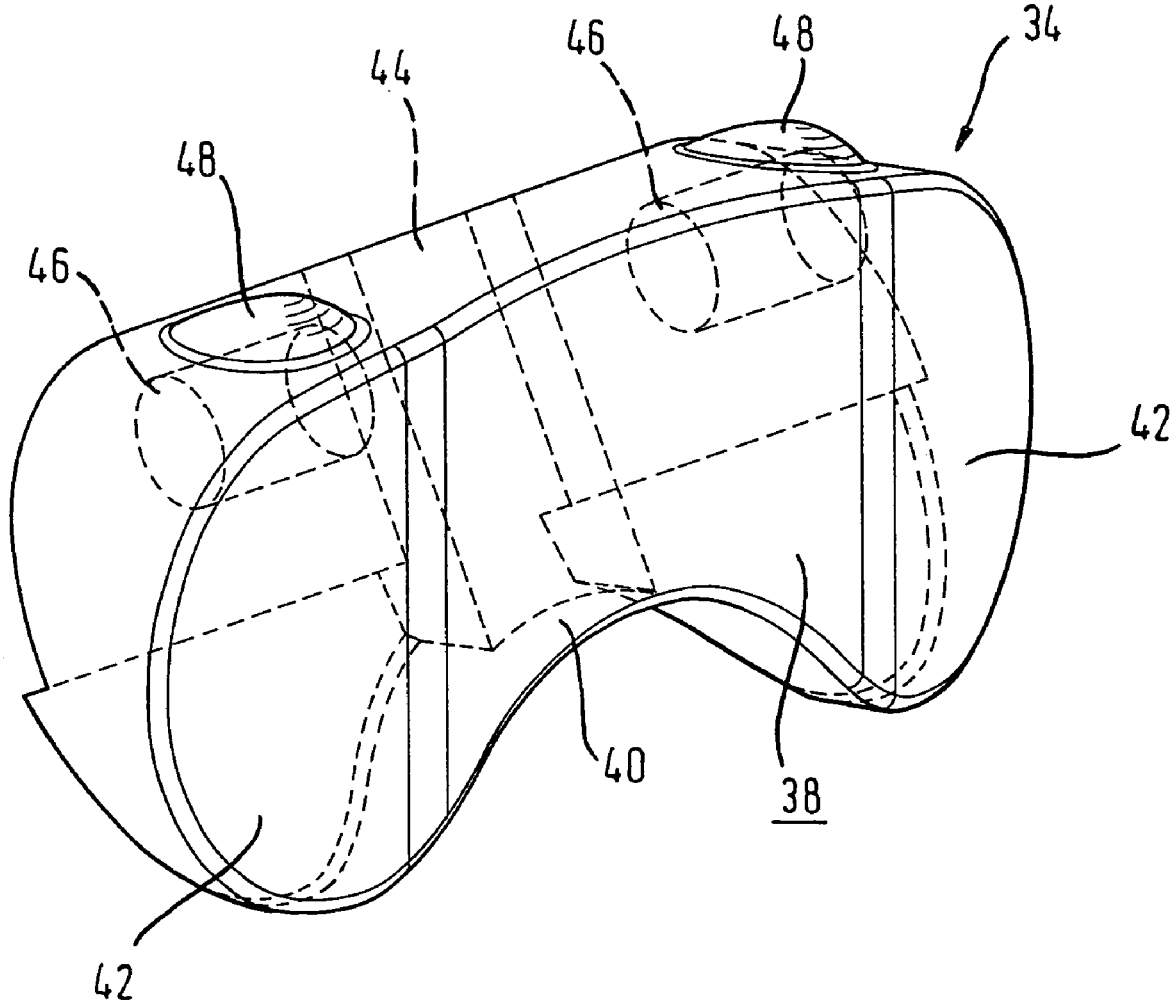
FIG. 5 shows a perspective view of a wearing plate used for a hinged tooth according to the invention.

The enlarged view of FIG. 5 shows the kidney-shaped front face 38 of the wearing plate 34, with bevellings 42 bordering laterally on a centre part 40. The bevellings 42 serve for a smooth and jolt-free sliding of the wearing plate 34 along the steering ridge 7 on the bearing shield 5.

On the rear facing away from the front face 38 of the plate a guide groove 44 is schematically indicated that serves to position the wearing plate 34 on the hinged tooth 10 easily and precisely. In addition, on the rear in an upper portion two schematically depicted threaded bores 46 are provided that serve to fix the wearing plate 34 onto the body 11 by means of screws. As a protection against wear and in order to guarantee an adequate stability material accumulations 48 are provided in the portion of the threaded bores 46.

The invention claimed is:

1. Hinged tooth for a cutting wheel having a cutting wheel hub and a pivot pin located on the cutting wheel hub, the hinged tooth comprising:

a pivot bearing for pivotally receiving the pivot pin, a cutting tooth support extending from the pivot bearing, the cutting tooth support having a receiving portion for receiving cutting teeth, and a steering arm extending from the pivot bearing substantially in a direction opposite to that of the cutting tooth support, wherein:

the pivot bearing, the cutting tooth support and the steering arm are designed as a one-piece support, a bearing eye is provided in the one-piece support for forming the pivot bearing, and a tapering is designed on the cutting tooth support between the pivot bearing and the receiving portion.

2. Hinged tooth according to claim 1, further comprising hardened cutting teeth detachably mounted in the receiving portion.

3. Hinged tooth according to claim 1, wherein the pivot bearing includes at least two mutually spaced bearing walls which are provided with a mutually coaxial bearing eye.

4. Hinged tooth according to claim 1, further comprising a stop member arranged in a portion of the steering arm.

5. Hinged tooth for a cutting wheel having a cutting wheel hub and a pivot pin located on the cutting wheel hub, the hinged tooth comprising:

a pivot bearing for pivotally receiving the pivot pin, a cutting tooth support extending from the pivot bearing, a steering arm extending from the pivot bearing substantially in a direction opposite to that of the cutting tooth support, and a cam follower detachably and exchangeably supported on the steering arm, wherein the cam follower is designed as a wearing plate bevelled at its lateral portions.

6. Hinged tooth according to claim 5, further comprising means for screwing the cam follower to the steering arm.

7. Hinged tooth according to claim 5, further comprising a guide groove between the steering arm and the cam follower.

8. Hinged tooth according to claim 5, wherein the cam follower is kidney-shaped.

9. A cutting wheel including at least one hinged tooth according to claim 1.

10. A trench cutter having at least one cutting wheel including at least one hinged tooth according to claim 1.

* * * * *